United States Patent [19]

Foley

[11] Patent Number: 4,775,921

[45] Date of Patent: Oct. 4, 1988

[54] LIGHTING FIXTURE DISPLAY SYSTEM

[75] Inventor: William Foley, Islington, Canada

[73] Assignee: Danbel Industries Inc., Toronto, Canada

[21] Appl. No.: 32,274

[22] Filed: Mar. 31, 1987

[51] Int. Cl.[4] ..... F21S 21/10

[52] U.S. Cl. ..... 362/147; 362/150

[58] Field of Search ..... 362/147, 148, 150

[56] References Cited

U.S. PATENT DOCUMENTS

| | | | |
|---|---|---|---|
| 3,504,172 | 3/1970 | Liberman | 362/150 |
| 3,885,147 | 5/1975 | Chacon | 362/150 |
| 3,964,378 | 6/1976 | Dunkelman | 99/375 |

*Primary Examiner*—Larry I. Schwartz

*Attorney, Agent, or Firm*—Rogers, Bereskin & Parr

[57] ABSTRACT

A panel and frame mounting system for electrical lighting fixtures. The system has a number of individual panels each of shallow box shape. Some panels have unbroken front surfaces and serve as filler panels. Other panels have rearwardly dished compartments which, together with the fixture bases, form enclosed metal electrical boxes to house connectors to the fixtures. The panels slide into a frame having rear hooks. The rear hooks suspend the frame on a mounting bar having brackets at its ends to fit into standard slotted tracks mounted on a wall. The frame can carry a power bar into which fixtures on the frame can be plugged.

26 Claims, 3 Drawing Sheets

LIGHTING FIXTURE DISPLAY SYSTEM

FIELD OF THE INVENTION

This invention relates to a system for displaying lighting fixtures. More particularly it relates to a modular panel and frame mounting system for such purpose.

BACKGROUND OF THE INVENTION

Lighting fixtures are commonly displayed for sale on walls of stores. Mounting the fixtures for display is presently a difficult task. The usual procedure is to prepare the display on large sheets of plywood or hardboard. The sheet of plywood or hardboard is drilled in appropriate locations; metal electrical boxes are mounted on the rear of the sheet, and the lighting fixtures are then installed on the front of the sheet and wired. The entire sheet is then raised and installed on a wall of a store. If an electrical box or bracket is off center or crooked, it is difficult to mount the sheet, particularly since the sheet hides the wall on which it is being mounted. In addition the work must often be carried out on a ladder or overhead.

Further, if it becomes necessary to move a fixture, the entire display sheet must be removed, new holes drilled, and the old holes in some manner covered. The result is that fabricating, installing and rearranging lighting displays has been a highly time consuming and inefficient task.

BRIEF SUMMARY OF INVENTION

The invention in one aspect provides a modular display panel and frame system which greatly reduces the time and effort needed to install a lighting fixture display system. In addition the invention makes it possible to remove fixtures, and to change the position of fixtures, quickly and efficiently and without removing the entire lighting fixture display.

In one of its aspects the invention provides a panel and frame mounting system for displaying electrical lighting fixtures, said system comprising:

(a) a frame having a plurality of cross members, said cross members being spaced apart and being parallel to each other, (b) a plurality of panels, each panel having flanges projecting from two opposed ends thereof, (c) said cross members each including support means thereon for removably receiving said flanges so that said panels may be removably mounted in said support means with one flange in the support means of one cross member and the other flange in the support means of another cross member, (d) at least some of said panels having means for removably mounting an electrical lighting fixture thereon.

In another aspect the invention provides a modular panel adapted to fit into a lighting fixture display frame, said panel being formed of sheet metal and having the form of a shallow box, said box having shallow top, bottom and side surfaces and a substantially flat front display surface, and having a pair of flanges extending from the rear edges of said top and bottom surfaces, said panel further including means for mounting an electrical lighting fixture on said front display surface.

In another aspect the invention provides a modular panel adapted to fit into a lighting fixture display frame, said panel having flanges projecting from two opposed ends thereof, said panel further including a substantially flat front display surface, and a rear compartment behind said front display surface, said rear compartment being adapted to house electrical connections to said electrical lighting fixture.

In still another aspect the invention provides a wall frame adapted to receive panels for displaying electrical lighting fixtures, said wall frame comprising:

(a) a pair of side members, (b) a plurality of cross members spaced vertically apart in parallel configuration, (c) said cross members including open ended channel means thereon to receive the ends of panels to be inserted therein, (d) hook means secured to the rear of at least some of said cross members, (e) and a mounting bar adapted to be secured to a wall, said mounting bar being dimensioned for said hook means to fit thereover to support said frame on said wall.

Further objects and advantages of the invention will appear from the following description, taken together with the accompanying drawings.

DETAILED DESCRIPTION OF PREFERRED EMBODIMENT

Figure 1:
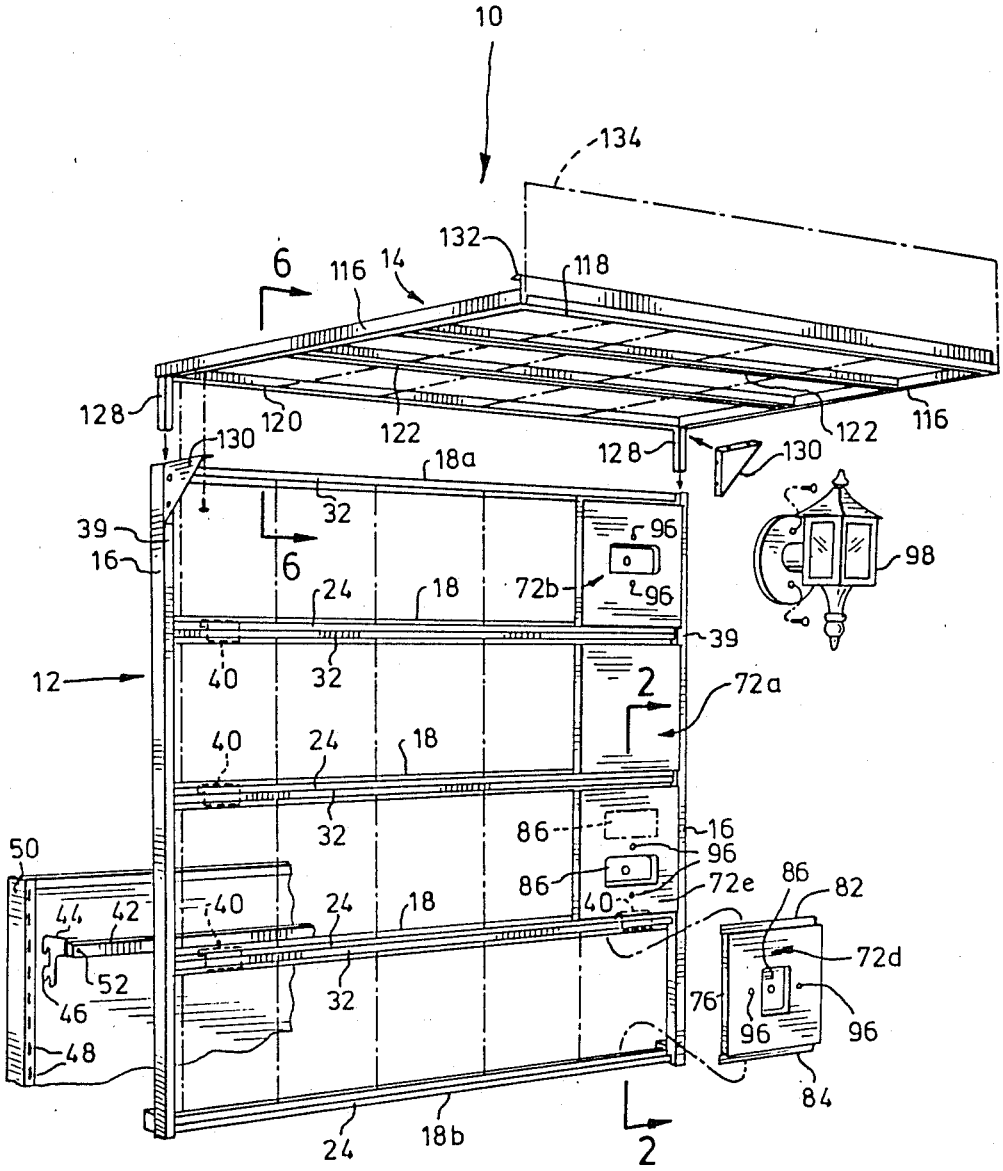
FIG. 1 is a perspective view of a lighting fixture display system according to the invention.

Reference is made to the drawings, which show a display system according to the invention and generally indicated at 10. The display system 10 includes a wall frame 12 and a ceiling frame 14. The wall frame 12 includes two spaced vertical side members 16, each formed of square metal tubing. The side members 16 are joined by a number of vertically spaced horizontal cross members 18. The cross members 18 are formed from rectangular metal tubing and are welded at each end to the side members 14. The cross members 18 are thinner in their front to rear dimension than are the side members 16 and are located so that their rear faces 20 (FIG. 2) are substantially flush with the rear faces 22 of the side members.

Figure 2:
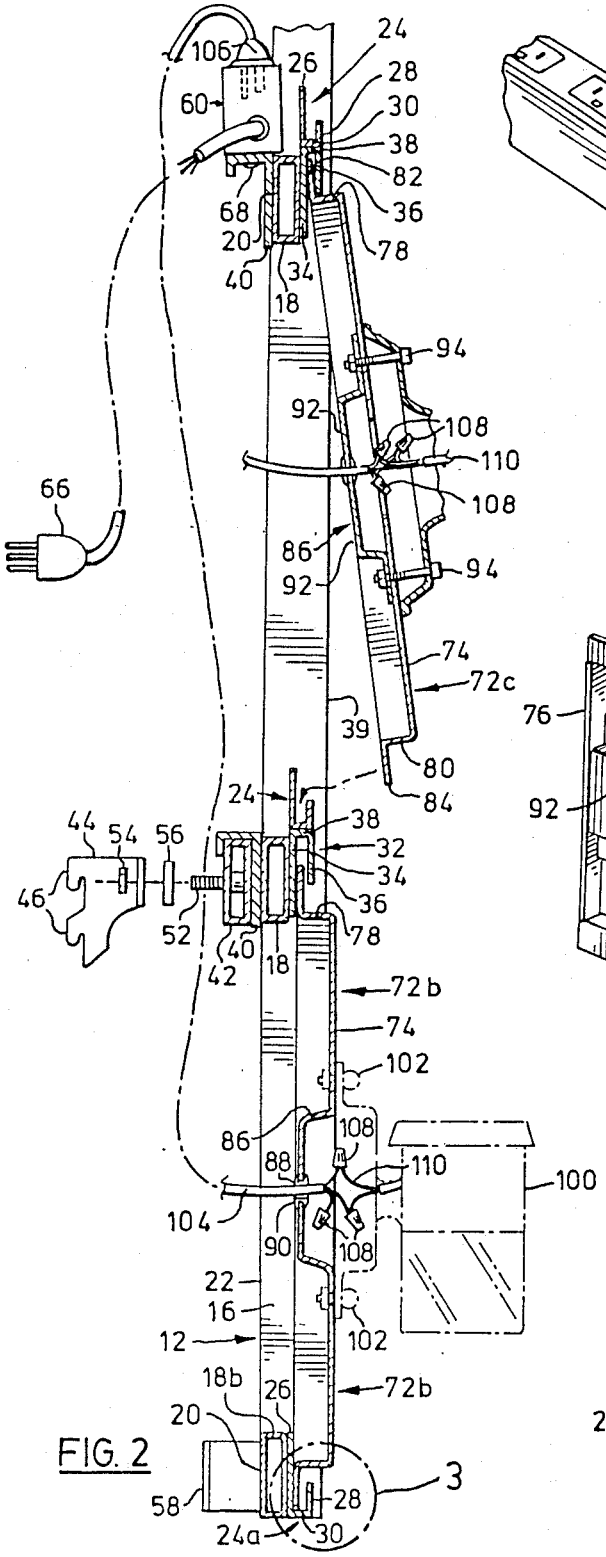
FIG. 2 is a sectional view taken along lines 2—2 of FIG. 1.
Figure 3:
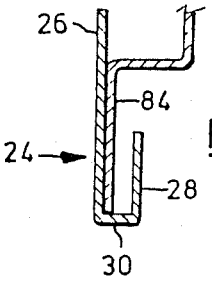
FIG. 3 is a sectional view of the portion marked 3 of the FIG. 1 system.

All of the cross members 18 except the upper cross member **18*a* have a panel bottom retention channel 24 extending thereacross. The panel bottom retention channel 24 is generally U-shaped in cross-section, as best shown in FIGS. 2 and 3, having a high vertical rear flange 26, a lower vertical front flange 28, and a horizontal web 30 which joins flanges 26, 28** at their bottoms.

All of the cross members 18 except the bottom cross member **18*b* also have a panel top retention channel 32** extending thereacross. The panel top retention channel 32 is also generally U-shaped, having a vertical rear flange 34, a vertical front flange 36, and a horizontal web 38 which joins the tops of flanges 34, 36. The front flange 36 of each panel top retention channel 32 is higher than the front flange 28 of each panel bottom retention channel 24, for a reason to be described.

The panel top retention channels 32 are all of sheet metal and all are welded directly to the front surfaces of the cross members 18. The panel bottom retention channels 24 (also of sheet metal) sit atop and are welded to the panel top retention channels 32, except for the lowermost panel bottom retention channel 24*a*. Channel 24*a* is welded directly to the front surface of its associated lower cross member 18*b*. The front flanges 28, 36 of the panel retention channels are all spaced slightly rearwardly of the front faces 39 of the frame side members 16.

The wall frame 12 is mounted to the wall of a store as follows. Each cross member 18 (except for the upper and lower cross members 18*a*, 18*b*) has a pair of saddle-shaped hooks 40 welded to its rear surface 20. The saddle hooks 40 are shaped to fit closely over a mounting bar 42. The mounting bar 42 is formed of rectangular metal tubing (typically of the same cross-section as the cross members 18). The mounting bar 42 is fitted at each end with a bracket 44 having rear hooks 46 which are adapted to fit into the slots 48 of standard slotted tracks 50 which are found (or can be provided) in most stores. The ends of the mounting bar 42 are secured to the brackets 44 by screws 52 which mate with nuts 54 in the brackets. Shims 56 can be provided where needed.

In use, the mounting bar 42 with its brackets 44 is mounted in the tracks 50 at a desired height. The wall frame 12 is then lifted and deposited over the mounting bar 42 and suspended thereon by the saddle hooks 40. Only one mounting bar 42 is necessary for this purpose. Standoffs 58 welded to the rear surface 20 of the lower cross member 18*b* at its ends ensure that the wall frame 12 is positioned vertically with respect to the wall. The standoffs 58 abut against the tracks 50.

Figure 5:
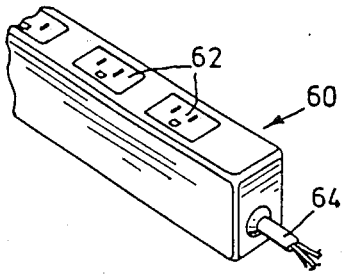
FIG. 5 is a perspective view of a portion of a power bar used with the FIG. 1 system.

To supply power to the various lighting fixtures which will be mounted on the frame 12, a power bar 60 (a portion of which is shown in FIG. 5) is provided. The power bar 60 is a rectangular enclosed sheet metal electrical box having a number of electrical outlets 62 mounted therein, with an electrical supply wire 64 connected to the outlets 62. The wire 64 extends from power bar 60 and terminates in a plug 66 which is plugged into a suitable outlet (not shown) on the store wall. The power bar 60 is secured to the upper surfaces of any suitable pair of saddle hooks 40 by self-tapping sheet metal screws 68 as shown in FIG. 2. The power bar 60 is of course mounted at an appropriate location on the saddle hooks 40 before the frame 12 is mounted on a wall.

The panels 72 which are used with the wall frame 12 will next be described. (Individual variations of the panels are marked as 72*a* 72*b* 72*c* but the panels collectively will be described using reference numeral 72.) As shown, each panel 72 has the form of a shallow rectangular box, having a large and generally flat front display surface 74, side surfaces 76, and top and bottom surfaces 78, 80. The side and top and bottom surfaces 76, 78, 80 are oriented at right angles to the front surface 74, extending rearwardly therefrom. Flanges 82, 84 extend vertically from the rear edges of the top surface 78 and the bottom surface 80 respectively. The box construction shown gives the panel substantial rigidity so that it can support the weight of a fixture without bending.

Some of the panels 72 are used simply as spacer or filler panels, and their front surfaces 74 are smooth and unbroken. Such a panel is shown at 72*a* in FIG. 1. However the front surface of each panel which is to mount a lighting fixture has a rearwardly dished rectangular portion 86. Located in the center of the dished portion 86 is an aperture 88 in which is fitted a grommet 90.

Figure 4:
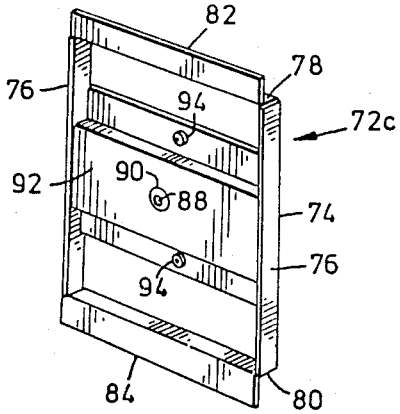
FIG. 4 is a rear perspective view of a panel for the FIG. 1 system.

The rearwardly dished portion 86 can be formed integrally with the panel by stamping, as shown for panel 72*b* in FIG. 2. Alternatively, and as shown for panel 72*c* in FIGS. 2 and 4, the rearwardly dished portion 86 can be a separate cover plate 92 which is held on by nuts and bolts 94.

The apparatus so far described is used as follows. Firstly, the wall frame 12 is installed on a suitable wall at the store in question, in the manner previously described. Next, fixtures are mounted on some of the panels 72. For this purpose, and as shown in FIG. 1, four different types of panels are provided.

The first type of panel, indicated at 72*b*, (FIGS. 1, 2) has the rectangular dished portion 86 extending rearwardly from its front face 74 as previously described. The dished portion 86 is oriented with its short sides vertical, and with screw holes 96 above and below its longer sides, to support a lighting fixture 98. The dished portion 86 in panel 72*b* is centered between the top and bottom of the panel 72*b*.

The second type of panel 72*d* (FIG. 1) is the same as panel 72*b* except that its dished portion 86 is oriented with its longer sides vertical and has the screw holes 96 located at each side of its dished portion 86.

The third type of panel 72*e* (FIG. 1) is the same as panel 72*b* except that the dished portion 86, instead of being centered between the top and bottom of the panel, is displaced slightly toward the bottom of the panel. If panel 72*e* were rotated 180 degrees in a vertical plane, then its dished portion 86 would be displaced toward the top of the panel, as shown in dotted lines in FIG. 1. In panel 72*e* the screw holes 96 are again located above and below the dished portion 86. Other locations for the dished portion 86 which need not be rectangular, may also be provided.

The fourth type of panel is the filler panel 72*a*, which as described has no opening in its front face 74.

In use, before a panel 72 is mounted on the frame 12, a fixture such as that shown in 98 in FIG. 1 or at 100 in FIG. 2 is mounted on the panel 72 by nuts and bolts 102 which extend through the screw holes 96 in the panel. (If the panel has a separate rear cover plate 92 as for panel 72*c* in FIG. 2, then the nuts and bolts 94 which hold the rear cover plate can also be used to hold the fixture base.) Power is provided to the fixture via an electrical wire 104 having a plug 106 at one end which plugs into the power bar 60. The other end of the wire 104 passes through the grommet 90 into the dished portion 86. Here its separate wires are connected by standard screw-cap connectors 108 to the wires 110 of the fixture. The electrical connections to the fixture are thus housed between the dished portion 86 and the base 112 of the fixture. Since the dished portion 86 and the fixture base 112 form a closed metal box, the arrangement complies with standard electrical codes. In particular, since the connectors 108 are contained entirely within a metal housing, they cannot be touched by anyone and therefore do not present a shock hazard, and they are not exposed to any combustible material should a short circuit occur.

After the lighting fixture has been mounted on the panel 72, the panel 72 is inserted into the frame 12 as follows. Since each panel top retention channel 32 is deeper than each panel bottom retention channel 24, the top flange 82 of the panel is slid upwardly as far as it will go into the top channel 32, as indicated for the panel 72*c* in FIG. 2. The lower end of the panel 72 is then swung rearwardly and the panel is moved downwardly so that its bottom flange 84 extends into the bottom channel 24, as shown for the panel 72*b* in FIG. 2. The fixture wire 104 can be plugged into the power bar 60 before the panel 72 is inserted in this manner. Alternatively the wire 104 can be plugged in later through the space left by one of the filler panels 72a, since the filler panels are not usually inserted until all of the fixture mounting panels have been mounted. As a further alternative, the power bar 60 can be eliminated and the fixtures plugged directly into wall outlets or into a power bar mounted on the wall.

With the arrangement shown, no separate electrical box need be mounted to a display board to receive each fixture. Instead each panel 72 is in effect the required electrical box.

The system shown also provides enormous flexibility. Fixtures can be added or removed without difficulty, simply by removing and replacing panels as required. In addition, if a long fixture requires extra support at its ends, away from its base, this can be provided by drilling the spacer panels and inserting extra screws where required.

Further, the system described, when shipped to a store, is much less likely to be damaged than is a complete panel with electrical boxes and (in some cases) fixtures mounted thereon. With the present invention the frame 12 can be shipped separately from the panels 72, and the desired fixtures can quickly be mounted to the required panels when the system arrives at a store. In addition, the fixtures can be mounted on the panels while the worker involved is standing on a floor, rather than on a ladder. Further, if a panel is damaged, only the damaged panel need be replaced and not an entire display board.

Figure 6:
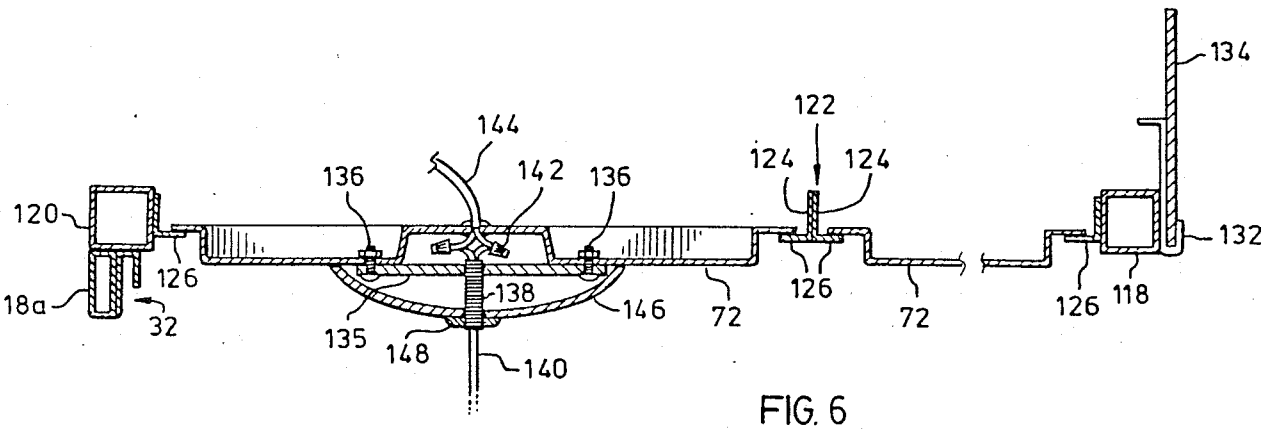
FIG. 6 is a sectional view taken along lines 6—6 of FIG. 1 and showing the ceiling portion of the FIG. 1 display.

If desired, and as shown in the drawings, the ceiling frame 14 may be added to the system. The ceiling frame 14 is similar in certain respects to the wall frame frame. The ceiling frame 14 is formed from two side frame members 116 and front and rear frame members 118, 120, all formed from square metal tubing welded together. The side frame members 116 are connected by cross members 122. The cross members 122 have the shape of an upside down T and are formed from pairs of L-shaped flange members 124 welded together and having their horizontal flanges 126 extending in opposite directions, as shown in FIG. 6. The reason for this somewhat simpler arrangement of cross members 122 is that the panel members 72 can simply lay thereon as shown in FIG. 6, so that channels to receive the flanges 82, 84 of the panels are not required.

The ceiling frame 14 has at its rear end two downwardly projecting posts 128, one at each rear corner thereof. The posts 128 are welded to side members 116 and are formed from square metal tubing (or solid metal) dimensioned to fit within the openings of the square metal tubing side frame members 16 of the wall frame 12. To install the ceiling frame 14, the posts 128 are fitted within the wall frame side members 16. Then triangular brackets 130 are drilled and screwed to the upper front surfaces of the side frame members 16 and to the rear lower rear surfaces of the side frame members 116. This helps to help support the ceiling frame 14.

If desired the ceiling frame can be fitted with a channel 132 extending along its front edge to hold a sign indicated at 134.

The ceiling frame 14 is usually used to support ceiling fixtures such as chandeliers, which are hung by a chain from the panels 72. In use, a desired ceiling fixture is mounted on a panel 72 before the panel is mounted on the ceiling frame 116. FIG. 6 shows a standard ceiling fixture support bar 135, secured to panel 72 by nuts and bolts 136, and having a standard threaded tube 138 threaded therein. The fixture electrical wire 140 extends through tube 138 and is connected by connectors 142 to a wire 144 which is plugged into the power bar 60. A cover plate 146 covers the connectors 142 and is held on the tube 138 by nut 148.

The panel 72 is mounted on the ceiling frame by holding it at an angle to the vertical, moving it upwardly through the opening between two cross members 122, then restoring it to a horizontal position and lowering it onto the flanges 124 of the cross members 122 to the position shown in FIG. 6.

The dimensions of the panels 72 are optional, but a suitable dimension has been found to be 9"×11 ½". preferably the panels 72 are rectangular, with their narrow dimension oriented in a side to side direction as shown in FIG. 1, since this allows more flexibility in mounting and spacing various fixtures.

Although the embodiment shown for the wall frame 12 employs cross members 18 to which channels 24, 32 are welded, alternatively, and if the channels 24, 32 are formed of sufficiently heavy metal, the rectangular tubing cross members 18 can be eliminated. The cross members 18 can then be formed simply from the channels 24, 32, the webs of which are welded together. In this event the saddle hooks 40 will be welded directly to the rear faces of the channels 24, 32 and will of course provide extra support in holding the channels together.

Depending on the type of electrical fixture used, the panels 72 in some cases need not have a rearwardly dished portion 86, since the base of the fixture may provide sufficient space for making the required electrical connections. However the rearwardly dished portion 86 is greatly preferred since it substantially facilitates mounting of fixtures and making electrical connections to them.

In addition, while the panels 72 have been shown as being of shallow box shape, they can made flat and rigidified in other ways, e.g. by making them of thicker metal or by welding or otherwise connecting supporting ribs to the rear surfaces thereof. In such event the ends of the panel front surfaces constitute the flanges 82, 84 which fit within the channels 24, 32. However the box configuration of the panels 72 is much preferred, since it is an inexpensive method of adding great strength to the panels. In addition it creates a very attractive appearance both for the individual panels and for the entire panel and frame display system. Typically the panels 72 are formed of sheet metal of 0.036 inches in thickness and may be painted with a high gloss enamel to enhance the attractive appearance of the system.

Figure 7:
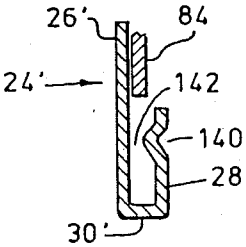
FIG. 7 is a sectional view showing a modification of the FIG. 3 arrangement.

If desired, the panel bottom retention channels 24 can include an inwardly crimped front flange 28', as shown in FIG. 7 where primed reference numerals indicate parts corresponding to those of FIGS. 1 to 6. The inward crimp 140 in the flange 28' creates a space between the front and rear flanges 28', 26' which at its narrowest point 142 is narrower than the thickness of the metal of a panel flange 84. The crimp 140 thus provides a spring pressure on the panel to help retain it in the channel in the event that a customer accidentally contacts and tends to lift a fixture.

I claim:

1. A panel and frame mounting system for displaying electrical lighting fixtures, said system comprising:.

(a) a frame having a plurality of cross members, said cross members being spaced apart and being parallel to each other, (b) a plurality of panels, each panel having flanges projecting from two opposed ends thereof, (c) each panel having the form of a shallow box, having shallow top, bottom and side surfaces and a substantially flat front display surface, said flanges extending from the rear edges of said top and bottom surfaces, (d) said cross members each including support means thereon for removably receiving said flanges so that said panels may be removably mounted in said support means with one flange in the support means of one cross member and the other flange in the support means of another cross member, (e) at least some of said panels having means for removably mounting an electrical lighting fixture thereon.

2. Apparatus according to claim 1 wherein said means for mounting an electrical lighting fixture includes a rear compartment behind said front display surface, said rear compartment being adapted to help house electrical connections to said electrical lighting fixture.

3. Apparatus according to claim 2 wherein each panel is formed of sheet metal and said rear compartment is an integral dish in said front display surface.

4. Apparatus according to claim 3 wherein each panel is formed of sheet metal and said rear compartment is a separate substantially U-shaped sheet metal portion extending across said panel and secured thereto.

5. Apparatus according to claim 1 wherein said front display surfaces of at least some of said panels are substantially closed and smooth for use as spacer panels.

6. Apparatus according to claim 1 wherein said frame is a wall frame and said support means for said panels are open ended channels.

7. Apparatus according to claim 1 wherein said frame is a wall frame and said support means for said panels are open ended channels, some of said channels facing downwardly and some of said channels facing upwardly, said downwardly facing channels being greater in height than said upwardly facing channels.

8. Apparatus according to claim 1 wherein said frame is a wall frame and said support means for said panels are open ended channels, some of said channels facing downwardly and some of said channels facing upwardly, said downwardly facing channels being greater in height than said upwardly facing channels, said upwardly facing channels each having a front flange, said front flange having an inwardly directed generally V-shaped formation therein to press on a said flange to help retain said flange in said upwardly facing channels.

9. A panel and frame mounting system for displaying electrical lighting fixtures, said system comprising:

(a) a frame having a plurality of cross members, said cross members being spaced apart and being parallel to each other, (b) a plurality of panels, each panel having flanges projecting from two opposed ends thereof, (c) said cross members each including support means thereon for removably receiving said flanges so that said panels may be removably mounted in said support means with one flange in the support means of one cross member and the other flange in the support means of another cross member, (d) at least some of said panels having means for removably mounting an electrical lighting fixture thereon, (e) said frame being a wall frame and including hook means secured to the rear of at least some of said cross members, said apparatus including a mounting bar adapted to be secured to a wall, said mounting bar being dimensioned for said hook means to fit thereover to support said frame on said wall.

10. Apparatus according to claim 9 wherein said mounting bar includes a pair of toothed brackets secured one to each end thereof, said brackets being adapted to be mounted on a slotted track secured to said wall.

11. Apparatus according to claim 9 and including an elongated power bar, said power bar comprising an enclosed metal housing containing a plurality of electrical outlets extending there along and having an electrical cord extending therefrom, said cord being adapted to be plugged into an electrical wall outlet, and means for mounting said power bar on said frame.

12. Apparatus according to claim 11 wherein said power bar is mounted on top of said hook means.

13. Apparatus according to claim 9 and including a ceiling frame, and means for mounting said ceiling frame on said wall frame, said ceiling frame having a plurality of cross members extending thereacross, said cross members including flange members for supporting said panels in a horizontal position.

14. Apparatus according to claim 13 wherein said wall frame includes side frame members each formed of rectangular tubing having a rectangular axial internal opening therein, and said ceiling frame includes a pair of rectangular posts extending downwardly from the rear corners thereof and adapted to fit into said rectangular openings.

15. A modular panel adapted to fit into a lighting fixture display frame, said panel being formed of sheet metal and having the form of a shallow box, said box having shallow top bottom and side surfaces and a substantially flat front display surface, and having a pair of flanges extending from the rear edges of said top and bottom surfaces, said panel further including means for mounting an electrical lighting fixture on said front display surface, said means for mounting an electrical lighting fixture includes a rear compartment behind said front display surface, said rear compartment being substantially closed as seen from the rear of said panel and being adapted to help house electrical connections to said electrical lighting fixture.

16. A panel according to claim 15 wherein said rear compartment is integrally formed as a dish in the sheet metal of said front surface.

17. A panel according to claim 15 wherein said rear compartment is a separate substantially U-shaped sheet metal member extending across said panel.

18. A wall frame adapted to recei e panels for displaying electrical lighting fixtures, said wall frame comprising:

(a) a pair of side members, (b) a plurality of horizontally oriented cross members spaced vertically apart in parallel configuration, (c) said cross members including open ended channel means thereon to receive the ends of panels to be inserted therein, (d) a plurality of hook members secured to the rear of at least some of said cross members, each hook memeber having an upper portion extending rearwardly from its associated cross member and a rear portion extending downwardly from the rear end of said upper portion, (e) and a mounting bar adapted to be secured to a wall, said mounting bar having an upper surface and a rear surface and being dimesioned for said hook means to fit removably thereover with said rearwardly extending portions of said hook members resting on said upper surface and said rear portions of said hook members overlying said rear surface to support said frame removably on said wall, so that said frame can be lifted into position and lowered to fit said hook members over said mounting bar to secure said frame to a wall.

19. A wall frame according to claim 18 and including a pair of spacer members mounted at the bottoms of said side members and projecting towards said wall to help orient said frame in a vertical position on said wall.

20. A wall frame according to claim 18 wherein said open ended channel means include upwardly facing channels and downwardly facing channels, said downwardly facing channels being of greater height than said upwardly facing channels.

21. A wall frame according to claim 20 and including an elongated power bar, said power bar comprising an elongated metal housing containing a plurality of electrical outlets extending thereon and having an electrical cord extending therefrom, said cord being adapted to be plugged into a wall outlet, and means for mounting said power bar on said wall frame.

22. A wall frame according to claim 21 wherein said power bar is mounted on top of said hook means.

23. A modular panel adapted to fit into a lighting fixture display frame, saod panel having flanges projecting from two opposed ends thereof, said panel further including a decorative substantially flat front display surface, and a rear compartment behind said front display surface, said front display surface being substantially larger in area than that of said rear compartment, said rear compartment being substantially closed as seen from the rear of said panel and being adapted to house electrical connectins to said electrical lighting fixture.

24. A modular panel according to claim 23 wherein said panel is formed of sheet metal and said rear compartment is an integral dish in said front display surface.

25. A modular panel according to claim 23 wherein said panel is formed of sheet metal and said rear compartment is a separate substantially U-shaped sheet metal portion extending across said panel and secured thereto.

26. A panel and frame mounting system for displaying electrical lighting fixtures, said system comprising:

(a) a frame having a plurality of cross members, said cross members being spaced apart and being parallel to each other, (b) a plurality of panels, each panel having flanges projecting from two opposed ends thereof, each panel further including a decorative substantially flat front display surface, (c) said cross members each including support means thereon may be removably mounted in said support means with one flange in the support means of one cross member and the other flange in the support means of another cross member, (d) at least some of said panels having means for removably mounting an electrical lighting fixture thereon, such means for removably mounting an electrical lighting fixture including a rear compartment behind said front display surface, said front display surface being substantially larger in area than that of said rear compartment, said rear compartment being substantially closed as seen from the rear of said panel and being adapted to house electrical connections to said electrical lighting fixture.

* * * * *